United States Patent [19]

Gressett, Jr.

[11] Patent Number: 4,915,432

[45] Date of Patent: Apr. 10, 1990

[54] DOOR HANDLE MOTION TRANSFER MECHANISM

[75] Inventor: Charles A. Gressett, Jr., Eagle Rock, Calif.

[73] Assignee: Adams Rite Manufacturing Company, City of Industry, Calif.

[21] Appl. No.: 286,178

[22] Filed: Dec. 19, 1988

[51] Int. Cl.[4] ..... E05C 21/02

[52] U.S. Cl. ..... 292/336.3; 292/DIG. 64

[58] Field of Search ..... 292/244, 245, 199, 166, 292/336.3, 140, DIG. 64

[56] References Cited

U.S. PATENT DOCUMENTS

| | | | |
|---|---|---|---|
| 1,213,651 | 1/1917 | Johns | 292/119 X |
| 3,011,330 | 12/1961 | Eads | 70/100 |
| 3,011,817 | 12/1961 | Eads | 292/140 |
| 3,368,374 | 2/1968 | Eads | 70/100 |
| 3,869,159 | 3/1975 | Eads | 292/92 |
| 4,052,092 | 10/1977 | Bergen | 292/358 X |
| 4,218,903 | 8/1980 | Eads | 70/107 |
| 4,458,928 | 7/1984 | Hirschbein | 292/92 |
| 4,790,583 | 12/1988 | Tonsmann et al. | 292/336.3 |

FOREIGN PATENT DOCUMENTS

| | | | |
|---|---|---|---|
| 1300293 | 6/1962 | France | 292/199 |

OTHER PUBLICATIONS

See U.S. Patent Application, Ser. No. 237,182, filed Aug. 29, 1988.

Von Duprin, "Exit Devices Touchbar/Crossbar" (pp. 1–5).

Monarch Hardware, 08716-MON, BuyLine 1293 (4 pages).

Corbin, "Exit Device Functions" (pp. 13–14).

"Sargent" literature (2 pages).

"Russwin" literature (1 page).

"Yale Exit Devices" literature (1 page).

*Primary Examiner*—Richard E. Moore

*Attorney, Agent, or Firm*—William W. Haefliger

[57] ABSTRACT

Apparatus for transferring door opening or closing motion, in response to rotation of a door handle, and comprises: a mounting structure; first, second and third elements carried by the mounting structure for movement relative thereto, the first and third elements coupled to the second element, the second element carried for bodily movement in response to rotation of the first element by the door handle, the third element being rotatable in response to bodily movement of the second element; a rotary output element connected to the third element; and at least two of the first, second and third elements having alternative coupling positions characterized in that in one position the output element is rotated clockwise when the handle is rotated clockwise, and in the other position the output element is rotated clockwise when the handle is rotated counterclockwise.

15 Claims, 9 Drawing Sheets

DOOR HANDLE MOTION TRANSFER MECHANISM

BACKGROUND OF THE INVENTION

This invention relates generally to door latch actuators and more particularly to an improved actuator enabling installation in different configurations to enable opening of the latch when the door handle is installed to be swung either clockwise or counterclockwise, and when the handle is installed "right-handed" or "lefthanded", to be swung in either direction, as will appear.

When door latch actuators carrying handles are installed, it may be necessary to produce either clockwise or counterclockwise rotation of the actuator output shaft, depending upon the installation; and it is desirable that a single actuator mechanism be usable for this purpose. Also, it is desirable that that same actuator mechanism be installable for either left or right handed operation. There is need for a simple, rugged, easily adjustable mechanism that is "universal" in its adaptability to any of the above modes of operation.

SUMMARY OF THE INVENTION

It is a major object of the invention to provide an improved latch actuating mechanism that is universal in its ability to be installed for operation in any of the above modes, i.e. to meet the above need. Basically, the mechanism of the invention includes:

(a) a mounting means, (b) first, second and third elements carried by the mounting means, for movement relative thereto, the first and third elements coupled to the second element, the second element carried for bodily movement in response to rotation of the first element by the door handle, the third element being rotatable in response to bodily movement of the second element, (c) a rotary output element connected to the third element, and (d) at least two of the first, second and third elements having alternative coupling positions characterized in that in one position the output element is rotated clockwise when the handle is rotated clockwise, and in the other position the output element is rotated clockwise when the handle is rotated counterclockwise.

It is another object of the invention to provide for connection of the first element to the handle, and for connection of the third element to an output element in the form of a rotary shaft. In this environment, it is another object to provide the second element in the form of a linearly movable slider having grooves in which pins A and B are received, pin A carried by the first element and pin B carried by the third element.

It is a further object to provide such grooves, which receive the pins, to be parallel and to extend normal to the direction of linear movement of said slider. As will appear each such groove may include two sections, respectively at opposite sides of a plane bisecting the grooves, at least one of the pins A and B being adjustably shiftable between the sections of its groove.

It is yet another object to provide a construction as referred to wherein the B pin is adjustably shiftable between the sections of its groove to reverse the direction of rotation of the rotary output element in response to rotation of the handle in a predetermined direction; and a further object is to provide a construction wherein the A pin is adjustably shiftable between the sections of its groove to permit usage of the handle on either side of the device.

A yet further object is to provide a locking part carried on the mounting means for movement into and out of locking position in which it blocks movement of one of said elements. As will be seen, the locking part typically blocks rotation of the first element in said locking position, as well as having a retracted position in which it limits rotation of the first element.

These and other objects and advantages of the invention, as well as the details of an illustrative embodiment, will be more fully understood from the following specification and drawings, in which:

DRAWING DESCRIPTION

FIG. 1 is a perspective view of a mechanism incorporating the invention;

FIG. 1*a* is a diagramatic view of the output shaft of the FIG. 1 mechanism, in door latch operating position;

Figure 1:
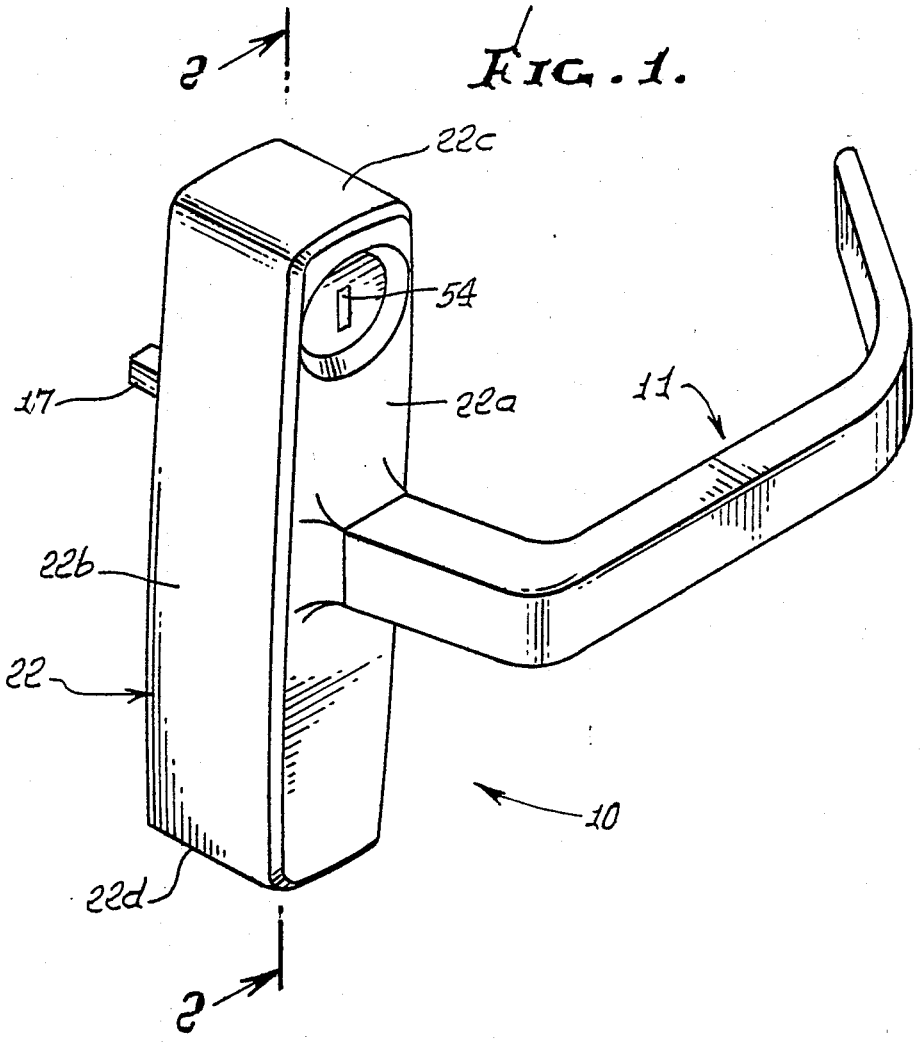
Figure 1A:
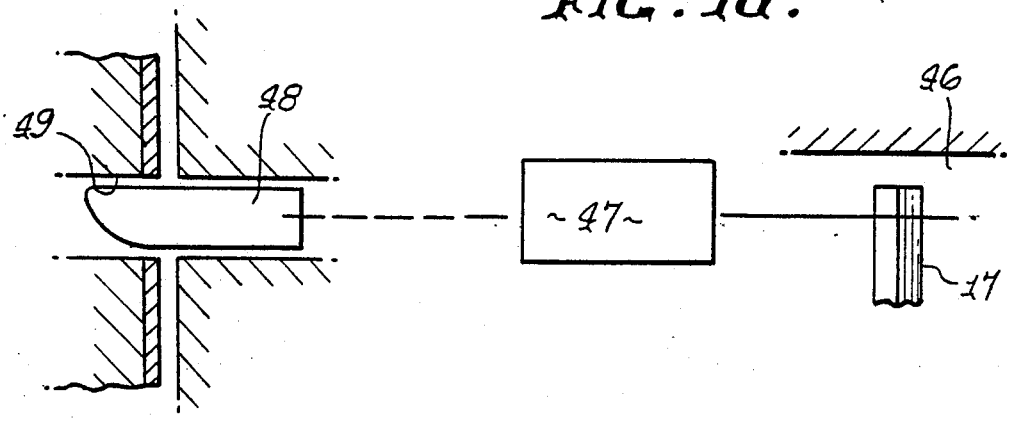
Figure 2:
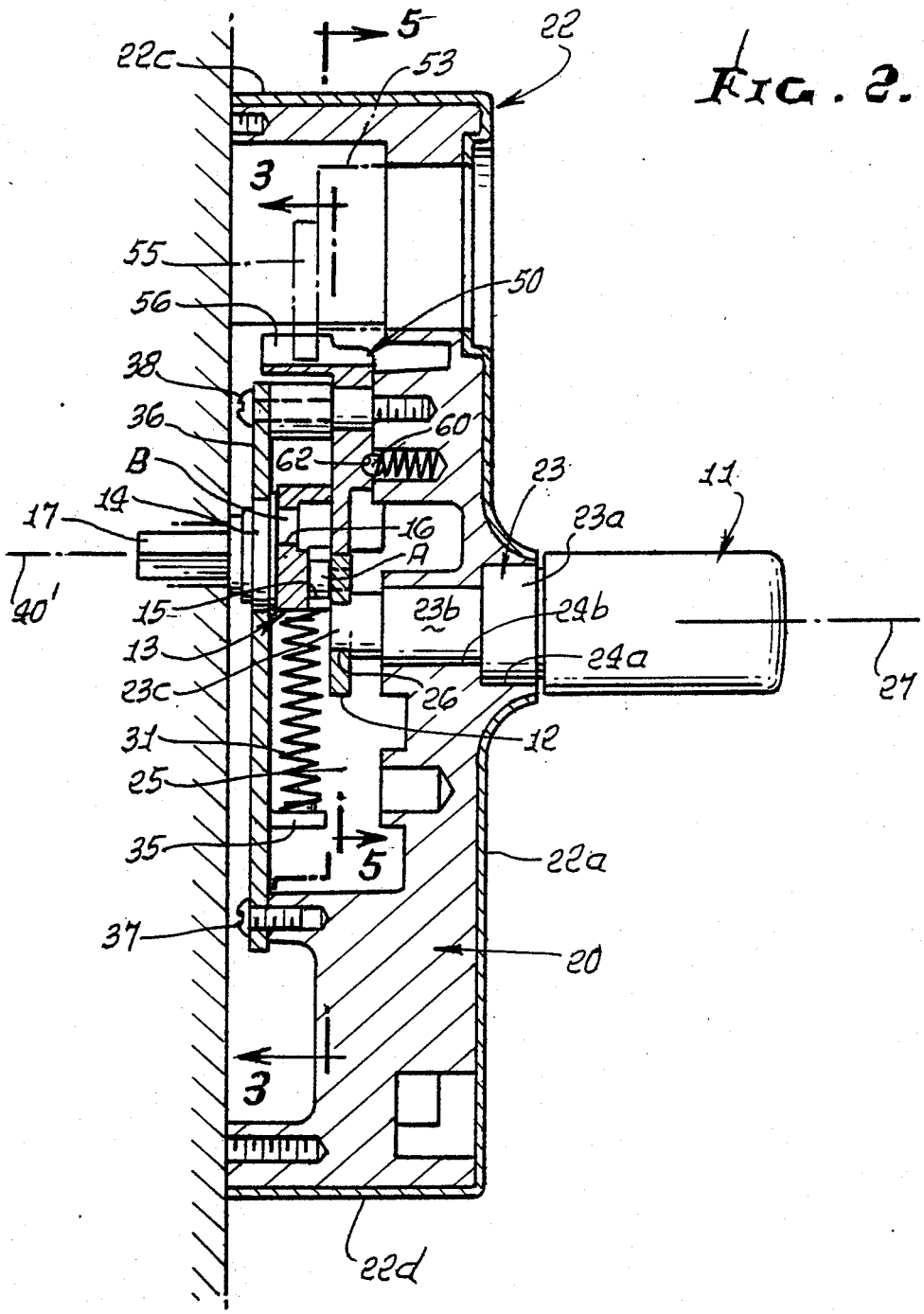
FIG. 2 is an enlarged vertical elevation, in section on lines 2—2 of FIG. 1.
Figure 3:
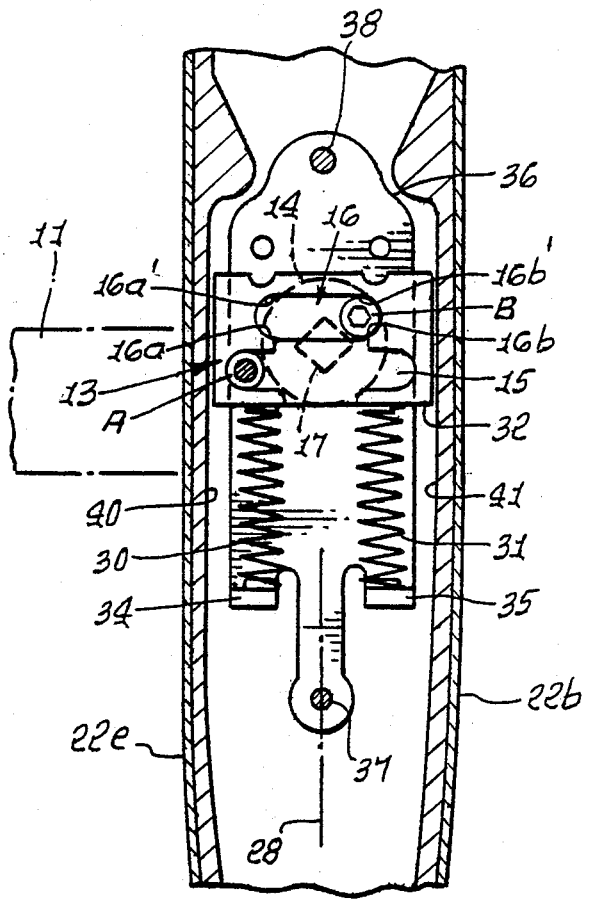
FIG. 3 is an elevation taken in section on lines 3—3 of FIG. 2.
Figure 4:
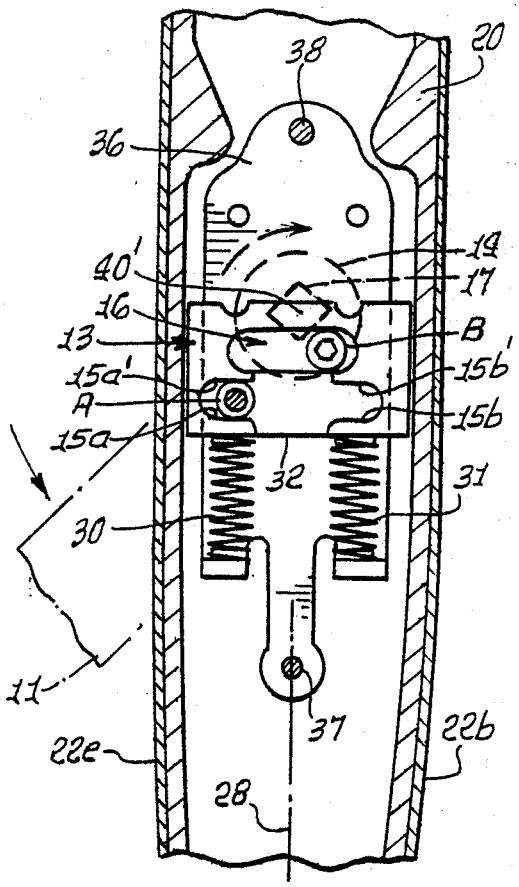
Figure 7:
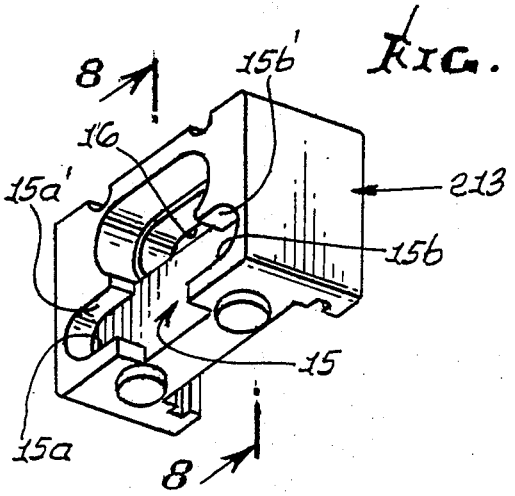
Figure 8:
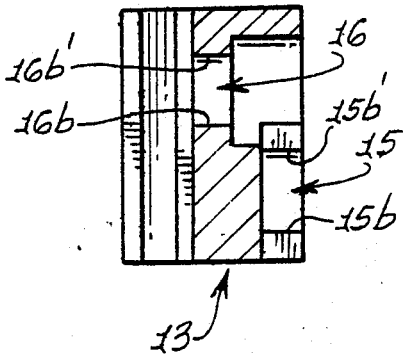
Figure 5:
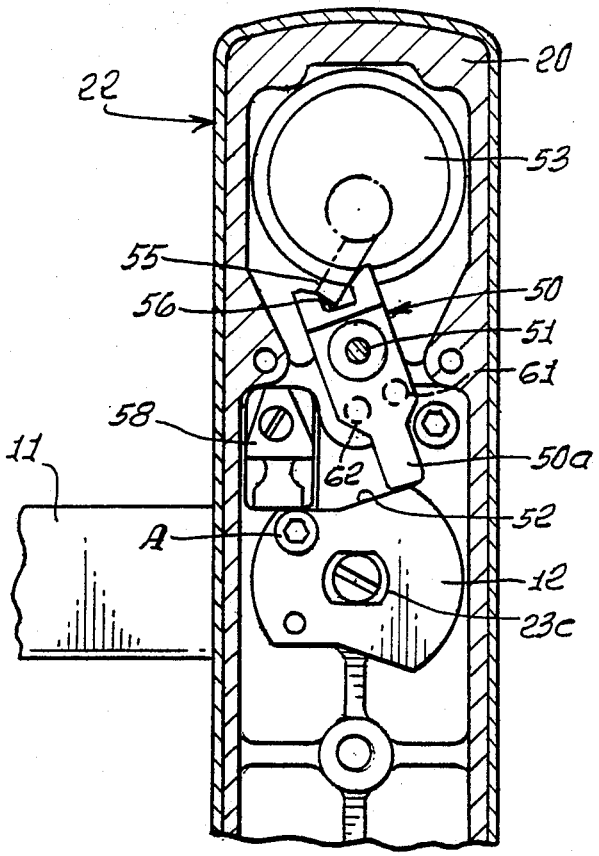
Figure 6:
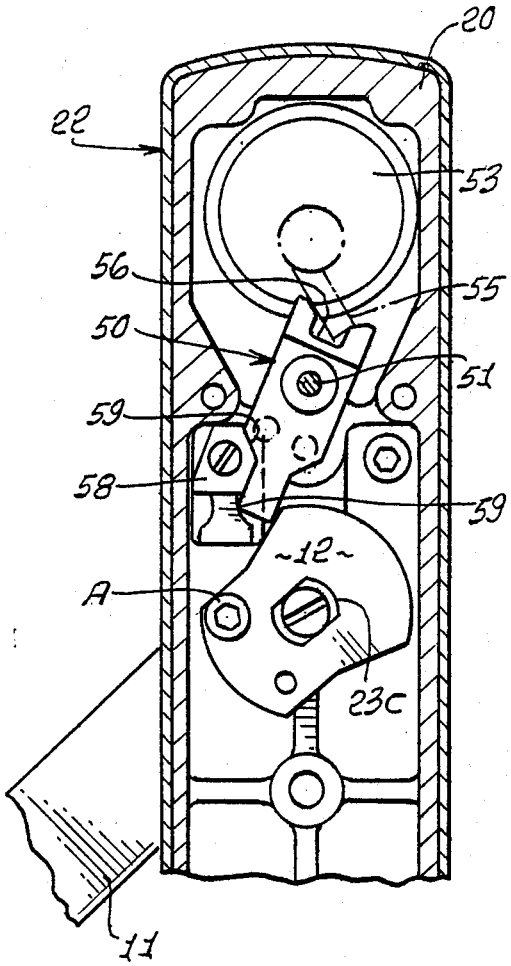
Figure 9:
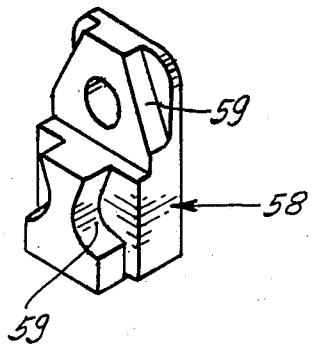
Figure 10:
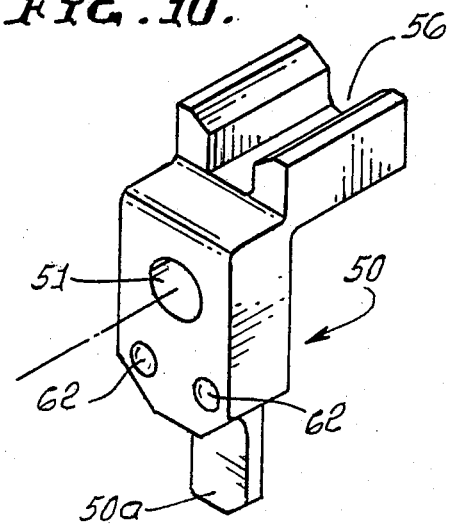
Figure 11:
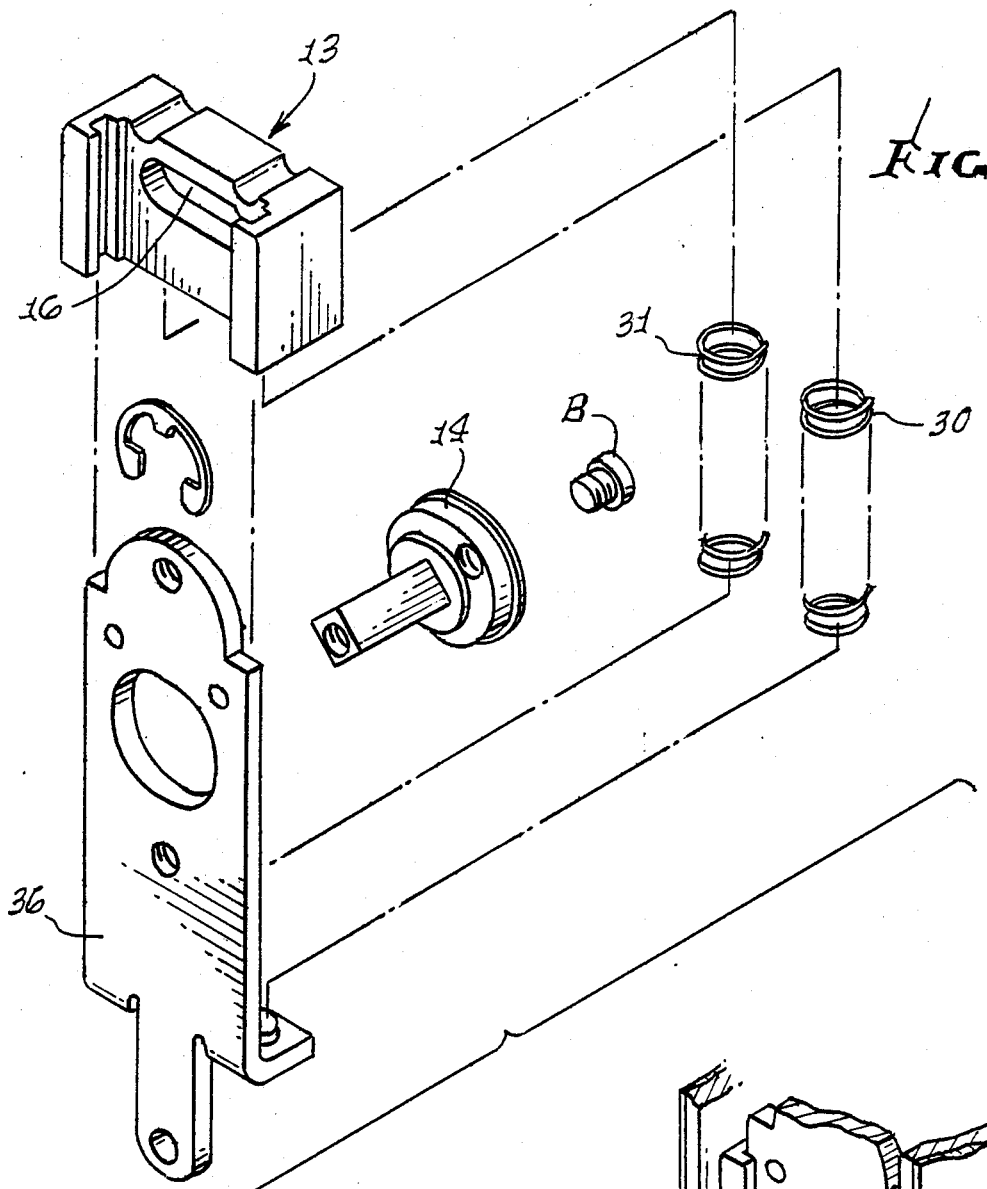
Figure 18:
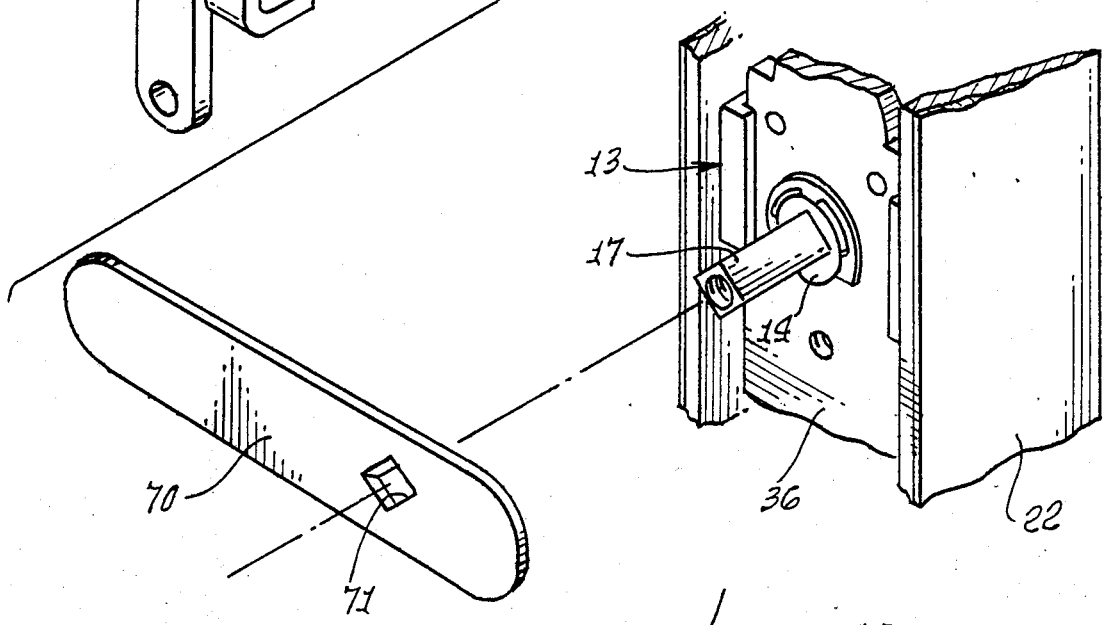
Figure 12:
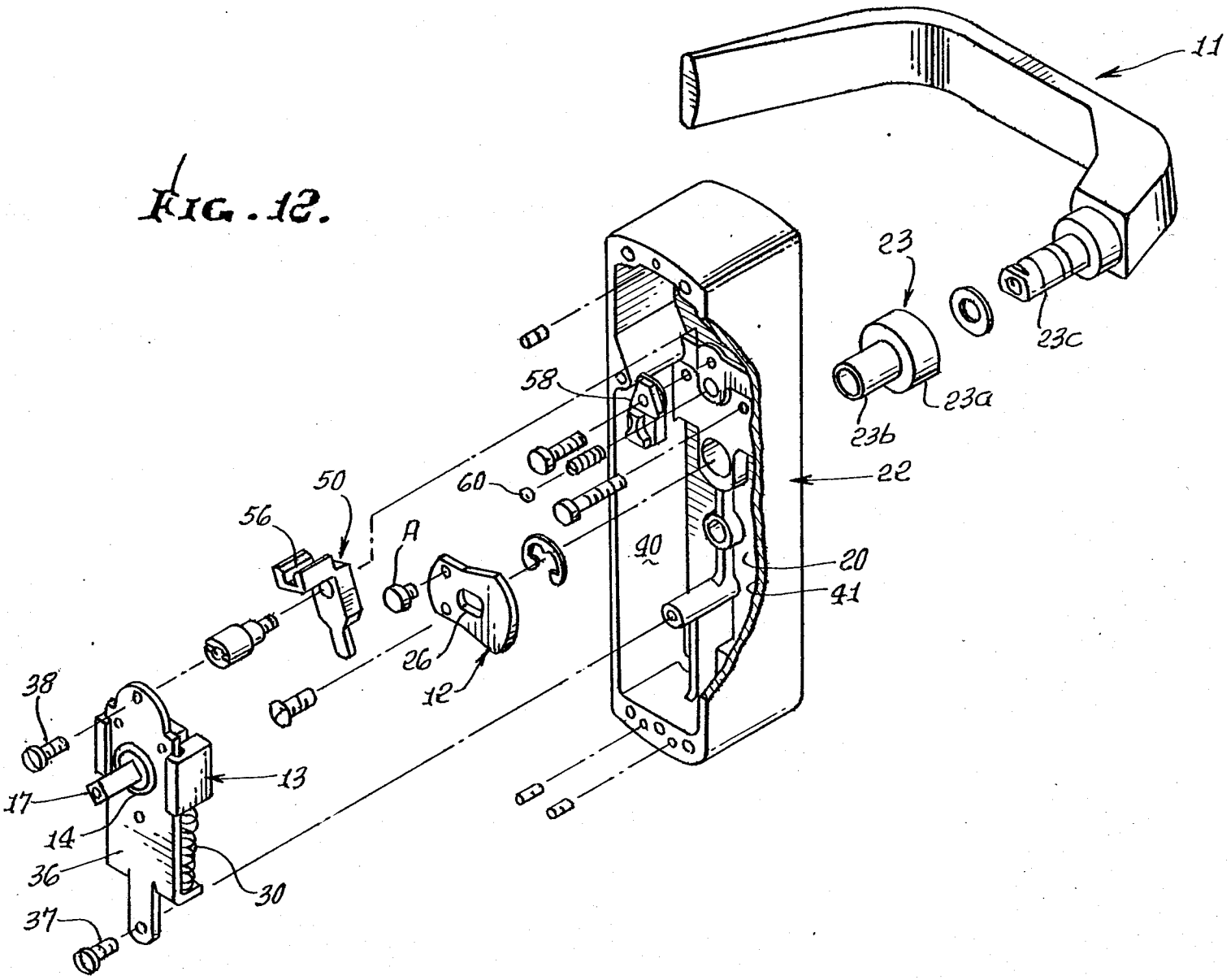
Figure 13:
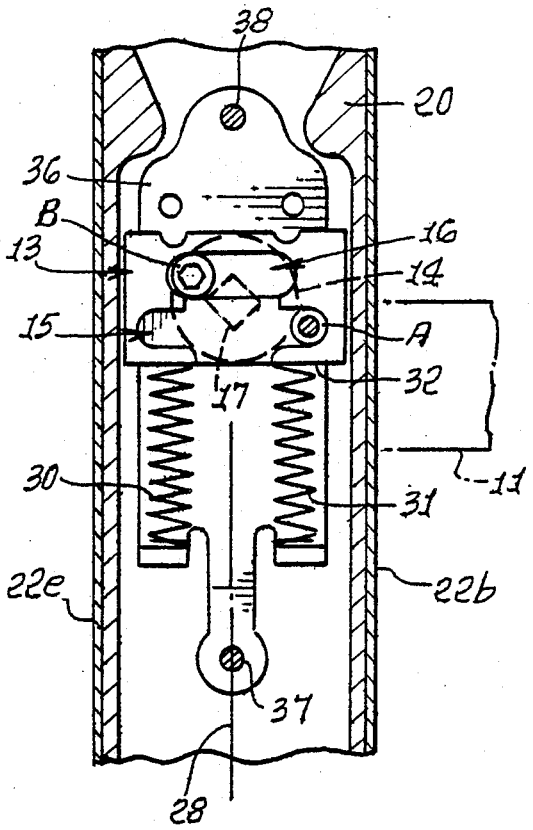
Figure 14:
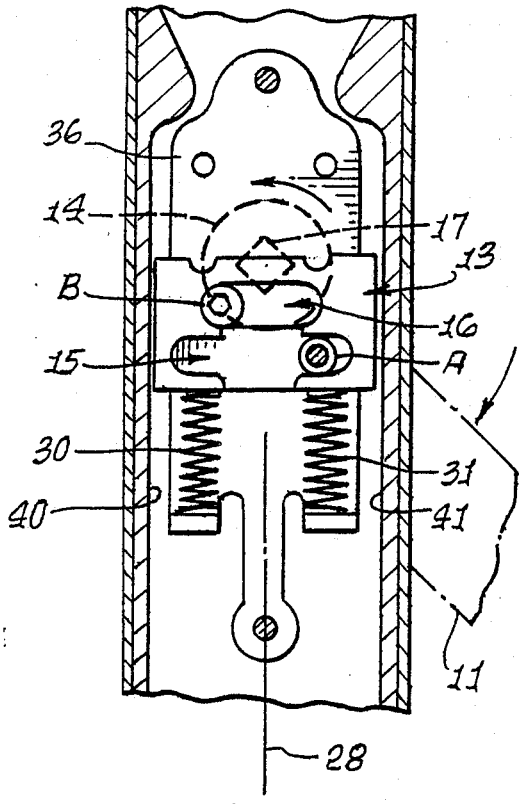
Figure 16:
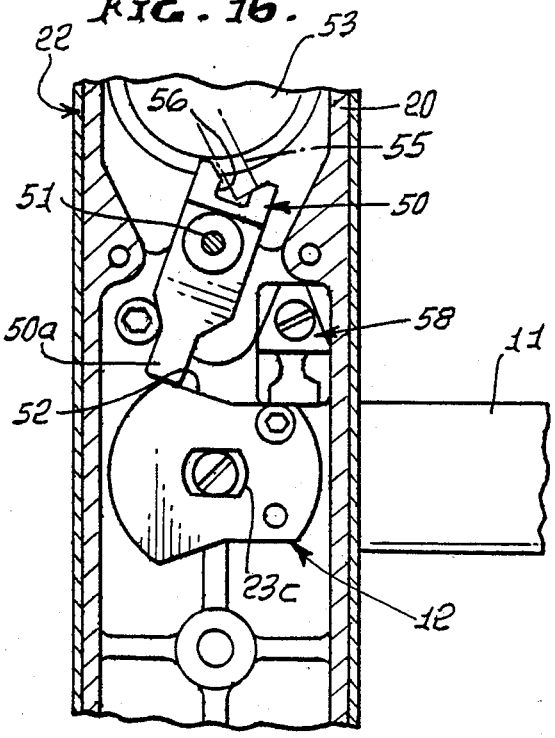
Figure 17:
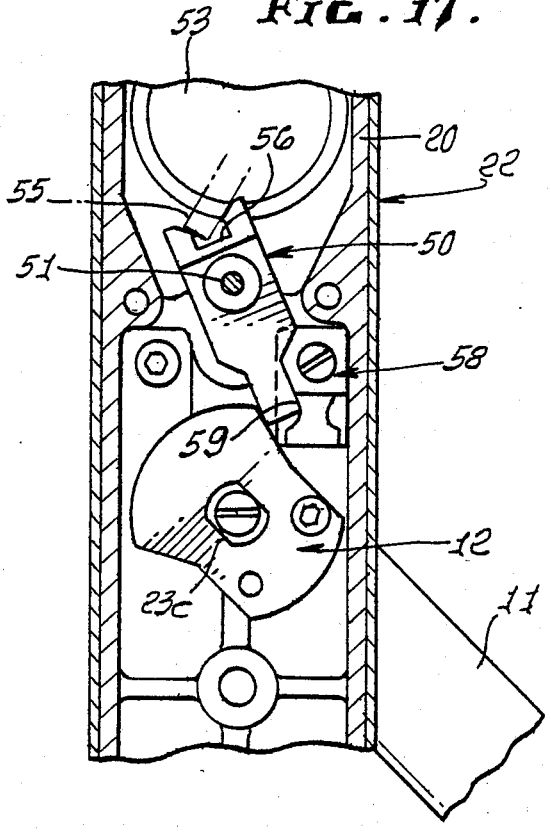
Figure 15:
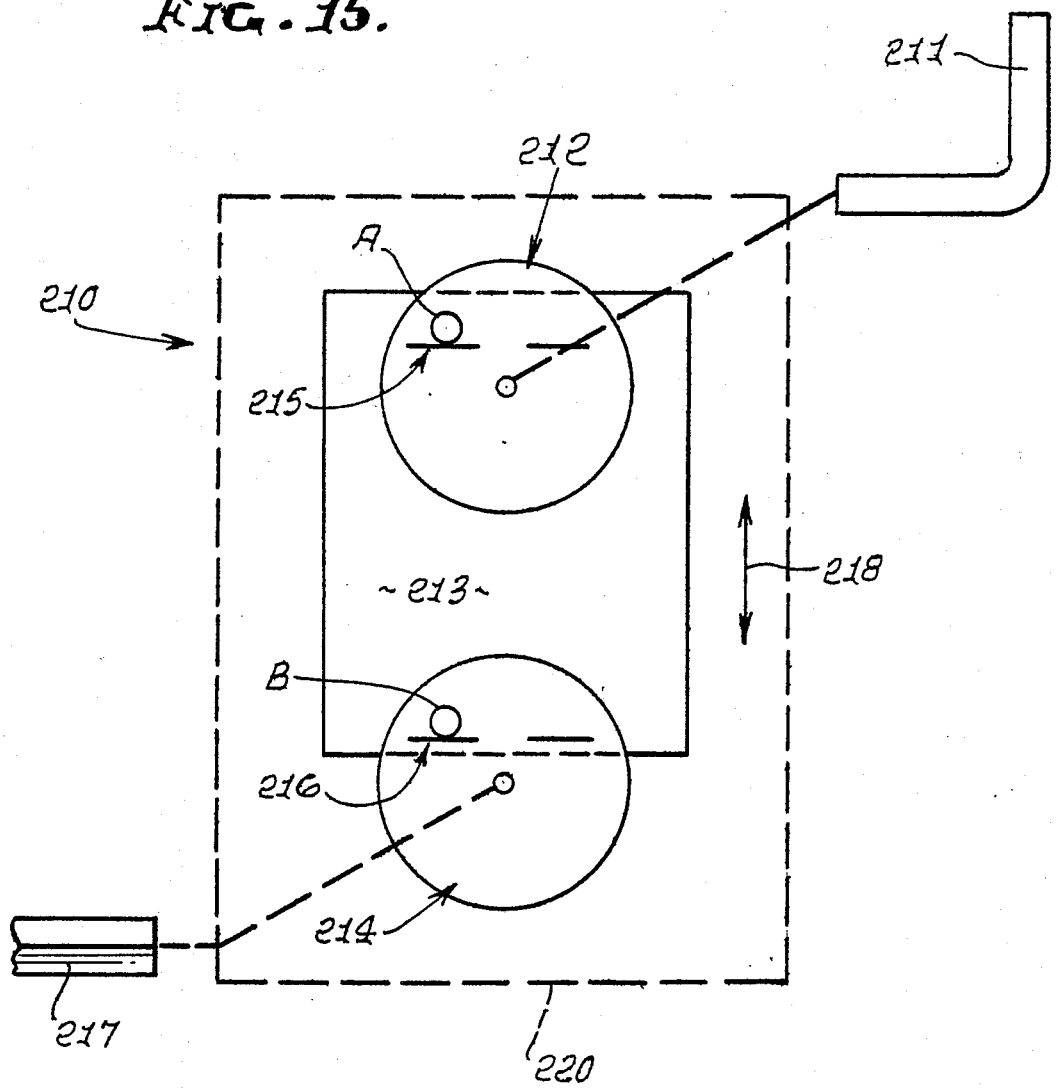
Figure 19:
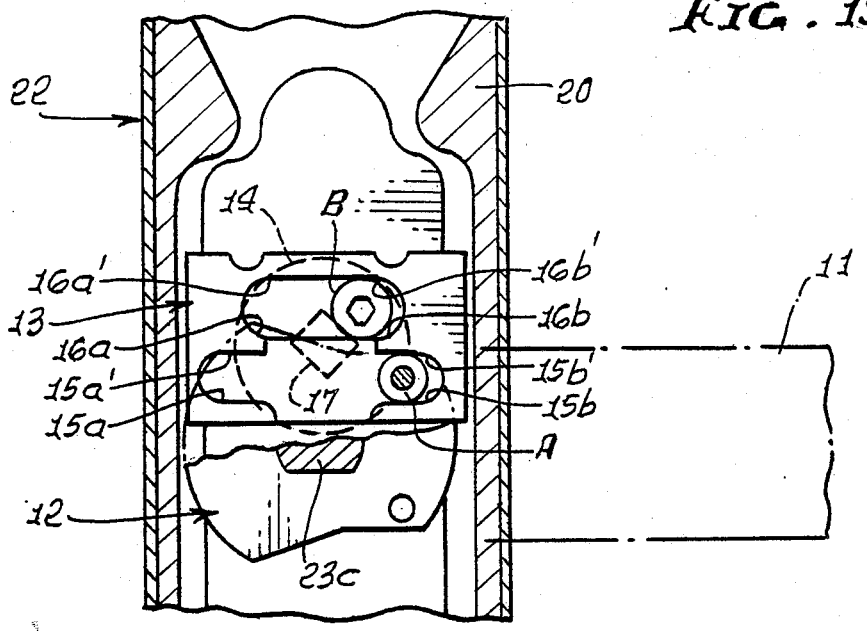
Figure 20:
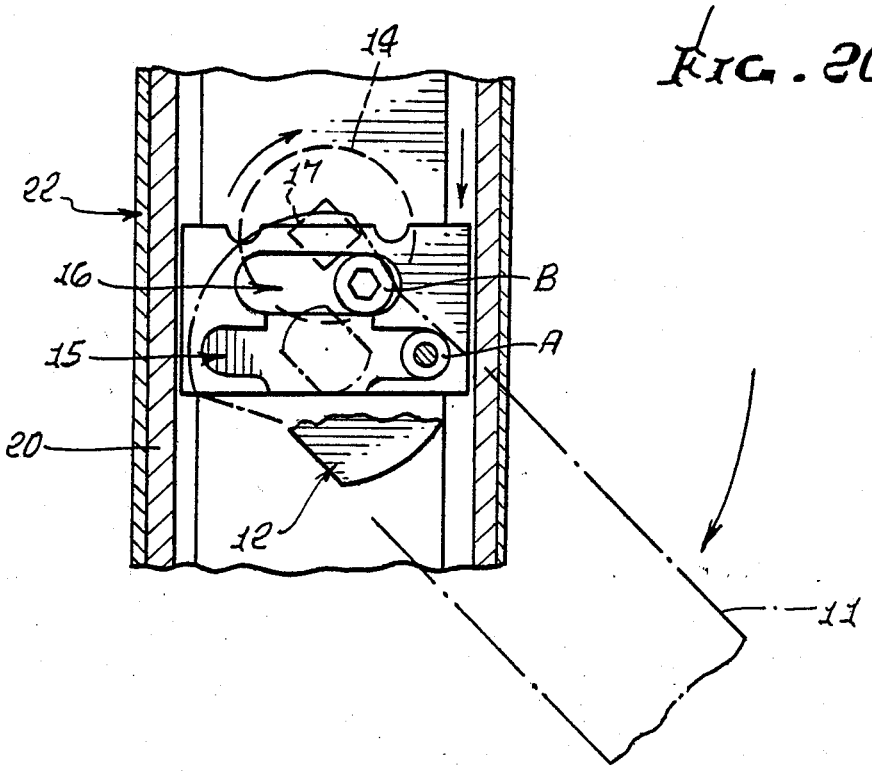

FIG. 4. is a view like FIG. 3, showing the position of elements after handle rotation;

FIG. 5 is an elevation taken in section on lines 5—5 of FIG. 2; and showing elements in locked position;

FIG. 6 is a view like FIG. 5 showing elements in unlocked position;

FIG. 7 is a perspective view of a sliding "window" block element;

FIG. 8 is a section taken on lines 8—8 of FIG. 7;

FIG. 9 is a perspective view of a "stop" block element;

FIG. 10 is a perspective view of a lock arm element;

FIG. 11 is an exploded view of certain elements the FIG. 1–10 mechanism;

FIG. 12 is an exploded view showing all of the parts of the FIGS. 1–11 mechanism;

FIG. 13 is a view like FIG. 3 showing parts positioned for use when the handle is "right-handed" instead of "left-handed" as in FIG. 3;

FIG. 14 is a view like 13 showing parts positioned after "right-handed" handle rotation, as to retract a door latch or bolt;

FIG. 15 is a diagrammatic view of basic elements;

FIG. 16 is a view like FIG. 5, but showing elements positioned for "left-handed" handle orientation, as in FIG. 13, and "locked";

FIG. 17 is a view like FIG. 16, but showing elements in "unlocked" position;

FIG. 18 is an exploded view showing use of a tool to engage and rotate the drive output (drive) shaft, to thereby shift a pin "B" in the mechanism to a position which reverses the direction of rotation at the output shaft in response to rotation of the handle;

FIG. 19 is a view like FIG. 13, but showing the pin "B" in shited position after use of the tool as in FIG. 18; and FIG. 20 is a view like FIG. 19, but showing the handle rotated and the parts displaced to effect output shaft rotation in "reverse" direction.

DETAILED DESCRIPTION

Referring first to FIG. 15, the diagrammatic view of apparatus 210 for transferring door opening or closing motion, in response to rotation of a door handle 211, includes:

(a) a mounting means, indicated by the broken line block 220;

(b) first, second and third elements (212, 213 and 214 respectively) carried by the mounting means for movement relative thereto, the first element 212 coupled to the second element 213 (as for example by a tongue and groove connection—pin A representing the tongue, and slot 215 in 212 representing the groove); the third element 214 also coupled to the second element 213 (as for example by a tongue and groove connection— pin B representing the tongue and slot 216 in 214 representing the groove); the second element 213 carried for bodily movement (sliding) in direction of arrows 218 in response to rotation of the first element 212 by the door handle; and the third element 214 being rotatable in response to bodily movement of the second element, as referred to, (c) a rotary output element 217 connected to the third element 214, (d) and at least two of the elements 212–214 having alternative coupling positions characterized in that in one of the latter the output element 217 is rotated clockwise when the handle is rotated clockwise (as in right handed position) and in the other of the alternative coupling position, the output element 217 is rotated clockwise when the handle is rotated counterclockwise (as in left handed position).

Referring now to the specific embodiment 10 shown in FIGS. 1–12 (other embodiments also being possible), the element-for-element correspondence with FIG. 15 is as follows:

| Element | FIG. 15 | FIGS. 1–12 |
|---|---|---|
| handle | 211 | 11 |
| mounting means | 220 (body) | 20 (body) |
| first element | 212 | 12 (drive rotor) |
| second element | 213 | 13 (slider or window block |
| third element | 214 | 14 (driven rotor) |
| tongue | A (pin) | A (pin or rotor 12) |
| groove | 215 | 15 |
| tongue | B (pin) | B (pin or rotor 14) |
| groove | 216 | 16 |
| rotary output element | 217 | 17 (shaft) |

In FIGS. 1–12, the body 20 is elongated, and closely fits within a housing shell 22 having an outer face **22*a*, and skirt defining skirt side walls 22*b* and 22*e*, and end walls 22*c* and 22*d*. Shell is typically metallic and may be anodized. Attached to the handle is a shaft 23 including sections 23*a*, 23*b* and 23*c*. Sections 23*a* and 23*b* fit within bores 24*a* and 24*b* in body 20**, for rotation relative to the body as the handle is rotated.

The body 20 forms a recess 25 into which rotor or plate 12, slider (window) block 13 and rotor or plate 14 are received. Rotor 12 is attached at 26 to the end of drive shaft section **23*c* to rotate pin A eccentrically relative to the shaft axis 27. Pin A projects into the laterally elongated window groove 15 defining primary cam surface sections 15*a* and 15*b* and also 15*a*' and 15*b*' (see FIGS. 3 and 4) at opposite sides of a vertical plane 28 bisecting the groove 15 and block 13. Groove 15 is formed by slider block 13, as a recess therein facing rightwardly in FIG. 2 toward rotor plate 12. Sections 15*a* and 15*b*** may be referred to as C and D sections, with which pin A is associated.

Likewise, pin B carried by driven rotor 14 projects into laterally elongated window groove 16 defining secondary cam surface sections **16*a* and 16*b* and also 16*a*' and 16*b*' (see FIGS. 3 and 4) at opposite sides of plane 28. Groove 16 is also formed by slider block 13, as a recess therein facing leftwardly in FIG. 2. Sections 16*a* and 16*b*** may be referred to as E and F sections.

Pin A functions as a primary cam, engaging one or the other of the primary cam follower surface sections C and D to displace the block 13 downwardly (see FIGS. 3 and 4) as the handle is rotated clockwise downwardly; and pin B functions as a secondary cam follower, engaged by one or the other of the secondary cam surface sections E and F acting to displace pin B downwardly (see FIGS. 3 and 4) as the block is displaced downwardly by pin A. Such downward displacement of block 13 is resiliently or yieldably resisted by two compression springs 30 and 31 endwise confined between the undersurface 32 of the block 13 and ledges 34 and 35. The latter project from a mounting plate 36 attached via fasteners 37 and 38 to body 20. Plate 36 extends to a plane parallel to the up-down movement of block 13, the latter slidably guided in its movement between plate 36 and plate or rotor 12, and also between body walls 40 and 41 seen in FIGS. 3 and 4. As the handle is rotated downwardly from FIG. 3 to FIG. 4 position, pin B is displaced downwardly to rotate the rotor 14 about its axis 40', i.e. axis of output shaft 17, whereby pin B is also displaced laterally, from FIG. 3 to FIG. 4 position. As the turned handle is released, the springs act to return block 13 upwardly to FIG. 3 position, whereby the pins A and B also return to FIG. 3 position. Note that pin A is slidably confined between sections **15*a* 25 and 15*a*', and pin B between sections 16*b* and 16*b*', (the shaft 17** rotating 90° ).

In the above description, the handle is to be rotated downwardly and counterclockwise (FIGS. 3 and 4). The invention also enables rotation of the handle downwardly and clockwise, to open the door, and for this purpose the parts may be installed as in FIGS. 13 and 14, which correspond to FIGS. 3 and 4, but differ in the confinement of pin A between surfaces **15*b* and 15*b*' instead of between surfaces 15*a* and 15*a*'; likewise, pin B remains between surfaces 16*a* and 16*a*', during pin A movement as seen in FIGS. 3 and 4. The parts are simply installed in the position, relative to plane 28, that correspond to the desired direction of handle displacement or turning, as shown. Note that the two grooves 15 and 16 extend in parallel, and normal to the up-down direction of handle movement of the slider block 13**.

FIG. **1*a* shows the output shaft 17 which rotates in a door recess 46 to operate mechanism 47 that in turn retracts bolt or latch 48 from keeper 49**. Different arrangements of such latches and keepers are of course possible.

Also, provided by the invention is a locking part carried on the mounting means (as for example body 20) for movement into and out of locking position, wherein it blocks movement of one of the elements 12, 13 and 14. In the example shown in FIGS. 5, 6, 9, and 10, the locking part is shown in the form of an arm 50 pivoted at 51 to the body 20. When pivoted into locking position as seen in FIG. 5, the arm lower end **50*a* engages the flat 52 at the upper edge of the drive plate 12, preventing rotation of that plate by the handle. Arm 50 is rotatable into that position by rotation of a lock rotor 53, as by means of a key inserted and accepted into a key slot 54 in that rotor (see FIG. 1). A dog 55 on that rotor is received into a recess 56 in the upper end of the arm 50, to rotate the arm as rotor 53 is turned. When the arm is rotated into unlocking position as seen in FIG. 6, the drive rotor 12 is unblocked, and may be rotated by the handle. A stop block 58 attached to body 20 limits unblocking rotation of the arm 50, by engagement therewith at surfaces 59. A spring urged detent ball 60 in body 20 is accepted in one or the other of the notches 61 and 62 in the arm 50, when the arm arrives at one or the other position as seen in FIGS. 5 and 6, for arm locating purposes. FIGS. 13–17 correspond to FIGS. 3–6**, respectively, and show parts positioned or installed (using the same mechanism) for "left-handed" handle positioning operation, instead of "right-handed" operation.

Finally, FIG. 18 shows a movable type tool 70 having a polygonal opening 71 to be received over the polygonal cross-section output shaft 17 for rotating it and rotor 14 through a predetermined angle, such as 270° to shift pin B from FIG. 13 position, to FIG. 19 position, whereby the direction of rotation of the output shaft 17 is reversed when the handle is turned. For example, note the following:

TABLE

| | FIG. 3 | FIG. 19 |
|---|---|---|
| direction of rotation of handle 11 | counter-clockwise | clockwise |
| direction of rotation of shaft 17 | clockwise | clockwise |

This feature accommodates the device, universally, to different latch retraction arrangements as found in different latching hardware on doors.

FIG. 20 is like FIG. 19, but shows the position of parts after the handle is rotated.

I claim:

1. In apparatus for transferring door opening or closing motion, in response to rotation of a door handle, the combination comprising:

(a) a mounting means, (b) first, second and third elements carried by the mounting means, for movement relative thereto, the first and third elements coupled to the second element, the second element carried for bodily movement in response to rotation of the first element by the door handle, the third element being rotatable in response to bodily movement of the second element, (c) a rotary output element connected to the third element, and (d) at least two of the first, second and third elements having alternative coupling positions characterized in that in one position the output element is rotated clockwise when the handle is rotated clockwise, and in the other position the output element is rotated clockwise when the handle is rotated counterclockwise, (e) the first element being operatively connected with the handle to be rotated thereby, and the third element being operatively connected with the rotary output element to rotate the rotary output element, (f) the second element comprising a generally linearly moveble slider interfitting two pins, A and B, pin A operatively carried by the first element, and pin B operatively carried by the third element.

2. The combination of claim 1 including a locking part carried on the mounting means for movement into and out of locking position in which it blocks movement of one of said elements.

3. The combination of claim 2 wherein the locking part blocks rotation of the first element in said locking position.

4. The combination of claim 3 wherein the locking part has a retracted position in which it limits rotation of the first element.

5. The combination of claim 1 wherein said second element is carried for linear movement by said mounting means.

6. The combination of claim 5 including spring means urging said second element in a direction to yieldably oppose rotation of the first element by the handle.

7. The combination of claim 1 wherein the first and second elements have primary cam and cam follower surfaces, and the second and third elements have secondary cam and cam follower surfaces.

8. In apparatus for transferring door opening or closing motion, in response to rotation of a door handle, the combination comprising:

(a) a mounting means, (b) first, second and third elements carried by the mounting means, for movement relative thereto, the first and third elements coupled to the second element, the second element carried for bodily movement in response to rotation of the first element by the door handle, the third element being rotatable in respnse to bodily movement of the second element, (c) a rotary output element connected to the third element, and (d) at least two of the first, second and third elements having alternative coupling positions characterized in that in one position the output element is rotated clockwise when the handle is rotated clockwise, and in the other position the output element is rotated clockwise when the handle is rotated counterclockwise, (e) the first and second elements having primary cam and cam follower surfaces, and the second and third elements having secondary cam and cam follower surfaces, (f) the primary cam follower surface having C and D sections and the secondary cam surface having E and F sections, the primary cam engaging the C section and the secondary cam follower engaging the E section when the handle is to be rotated clockwise, and the primary cam engaging the D section and the secondary cam follower engaging the F section when the handle is to be rotated counterclockwise.

9. The combination of claim 1 wherein the first element is directly connected with the handle to be rotated thereby, and the third element is directly connected with the rotary output element in the form of a shaft, to rotate the shaft.

10. In apparatus for transferring door opening or closing motion, in response to rotation of a door handle, the combination comprising:

(a) a mounting means, (b) first, second and third elements carried by the mounting means, for movement relative thereto, the first and third elements coupled to the second element, the second element carried for bodily movement in response to rotation of teh first element by the door handle, the third element being rotatable in response to bodily movement of the second element, (c) a rotary output element connected to the third element, and (d) at least two of the first, second and third elements having alternative coupling positions characterized in that in one position the output element is rotated clockwise when the handle is rotated clockwise, and in the other position the output element is rotated clockwise when the handle is rotated counterclockwise, (e) said first element being connected with the handle to be rotated thereby, and the third element oonnected with the rotary output element in the form of a shaft, to rotate the shaft, (f) the second element being a linearly movable slider having grooves in which pins A and B are received, pin A carried by the first element and pin B carried by the third element.

11. The combination of claim 10 wherein said grooves, which receive said pins, are parallel and extend normal to the direction of linear movement of said slider.

12. The combination of claim 11 wherein each groove includes two sections, respectively at opposite sides of a plane bisecting the grooves, at least one of the pins A and B being adjustably shiftable between the sections of its groove.

13. The combination of claim 12 wherein the B pin is adjustably shiftable between the sections of its groove to reverse the direction of rotation of the rotary output element in response to rotation of the handle in a predetermined direction.

14. The combination of claim 12 wherein the A pin is adjustably shiftable between the sections of its groove to maintain the downward motion thus imparted by handle via the first element and pin A to slider when the direction of rotation of the handle is reversed.

15. The combination of claim 8 wherein the second element is movable longitudinally linearly, the surfaces C, D, E, and F are carried on the second element, the C and D surfaces offset laterally and extending laterally, and the E and F surfaces offset laterally and extending laterally.

* * * * *